US006168489B1

(12) United States Patent
Huston

(10) Patent No.: US 6,168,489 B1
(45) Date of Patent: Jan. 2, 2001

(54) FLOAT TUBE WITH PONTOONS

(75) Inventor: David Huston, McMinnville, OR (US)

(73) Assignee: Caddis Manufacturing, Inc., McMinnville, OR (US)

( * ) Notice: Under 35 U.S.C. 154(b), the term of this patent shall be extended for 0 days.

(21) Appl. No.: 09/107,541

(22) Filed: Jun. 30, 1998

(51) Int. Cl.[7] ..... B63B 35/78
(52) U.S. Cl. ..... 441/130; 441/132
(58) Field of Search ..... 441/129–132, 441/40, 44, 45, 126; 114/345, 61.25

(56) References Cited

U.S. PATENT DOCUMENTS

| | | | | |
|---|---|---|---|---|
| 2,407,666 | * | 9/1946 | Kearny | 114/345 |
| 3,659,298 | * | 5/1972 | Edwards | 114/345 |
| 3,740,095 | * | 6/1973 | Nail | 297/454 |
| 4,782,777 | * | 11/1988 | Sussman | 114/39.1 |
| 5,171,178 | * | 12/1992 | Creek et al. | 441/132 |
| 5,222,779 | * | 6/1993 | Johnson | 297/191 |
| 5,732,650 | | 3/1998 | Peterson | 114/345 |

FOREIGN PATENT DOCUMENTS

| | | | | |
|---|---|---|---|---|
| 33 04 702 A1 | * | 8/1984 | (DE) | 114/61.25 |

* cited by examiner

*Primary Examiner*—Sherman Basinger
(74) *Attorney, Agent, or Firm*—Chernoff, Vilhauer, McClung & Stenzel

(57) ABSTRACT

A float tube has a pair of separate side-by-side pontoons, each comprising a pontoon cover and an inflatable bladder. A generally U-shaped support, having a separate cover and bladder, is mounted on top of the pontoons. The support has a pair of arms which overlay portions of the pontoons and the cover of each arm is attached to one of the pontoon covers. The support also has a back support member which spans between the two arms. The back support member serves to interconnect the two pontoons and maintain the proper spacing between them, and be a back support for someone sitting in the float tube. A flexible seat extends between the two pontoons in front of the back support and a rigid separation element extends between the two pontoons in front of the seat to keep the pontoons parallel. A headrest, having a separate cover and bladder, is located above the back support member.

2 Claims, 3 Drawing Sheets

FLOAT TUBE WITH PONTOONS

BACKGROUND AND SUMMARY OF INVENTION

Float tubes are commonly used by fishermen to float on lakes to reach fishing locations unavailable from the shore. The body of these float tubes has heretofore either been an annular tube or a U-shaped tube. In both types, an inflatable bladder is inserted inside of a tougher puncture resistant cover. In the case of the annular tube, a seat extends across the opening in the center of the tube, and in the case of the U-shaped tube, a seat extends across the arms of the U. An inflatable backrest is placed across the arms of the U or on one side of the annular tube behind the seat.

A related fishing device, commonly referred to as a pontoon boat, comprises a pair of side-by-side, spaced-apart inflatable pontoons, with a seat and backrest extending between them. Again, the pontoons comprise inflatable bladders which are placed inside of tougher puncture resistant covers. Generally, the seat is built on a rigid frame which holds the pontoons in their proper spaced-apart orientation.

In general, a pontoon boat is easier to propel than a float tube and has two bladders rather than one, which gives it a larger capacity and the ability to remain buoyant if one of the tubes is punctured. In addition, a pontoon boat can be made to seat the user higher off of the water and is more comfortably than in a float tube. However, because of the rigid structure that extends between pontoon boat pontoons to keep them at their proper spacing and provide the seat and backrest, float tubes are much lighter and collapse into a much smaller package when deflated. Thus, float tubes are easier to pack into a remote location.

The subject invention provides most of the advantages of both float tubes and pontoon boats by using a pair of separate, elongate, cylindrical pontoons with inflatable bladders located inside of covers. On top of the pontoons is a generally U-shaped support having its own cover and bladder. The support has arms that overlay the pontoons, with the arms of the support cover being attached to the pontoon covers. The support also has a back support member which interconnects the arms. The support serves to both interconnect the pontoons with the desired spacing between them and as a backrest. Thus, there are three separate bladders, all of which can be completely deflated to permit the device to be transported.

In a preferred embodiment of the invention, a headrest having a separate bladder in a separate cover is located on top of the support. A seat extends between the pontoons in front of the back support member and a separation element is located in front of the seat.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
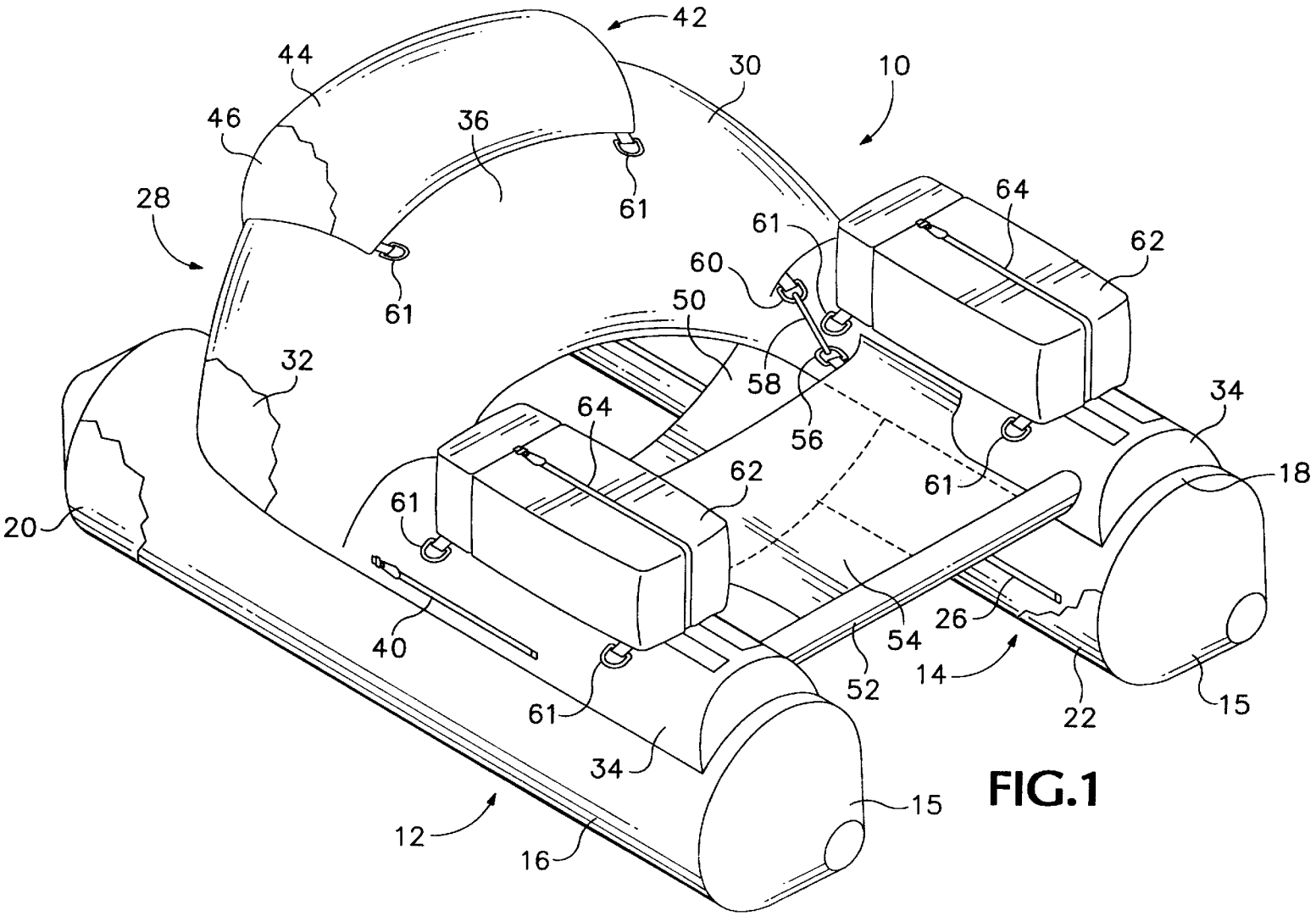
FIG. 1 is a perspective view of a float tube embodying the subject invention.
Figure 2:
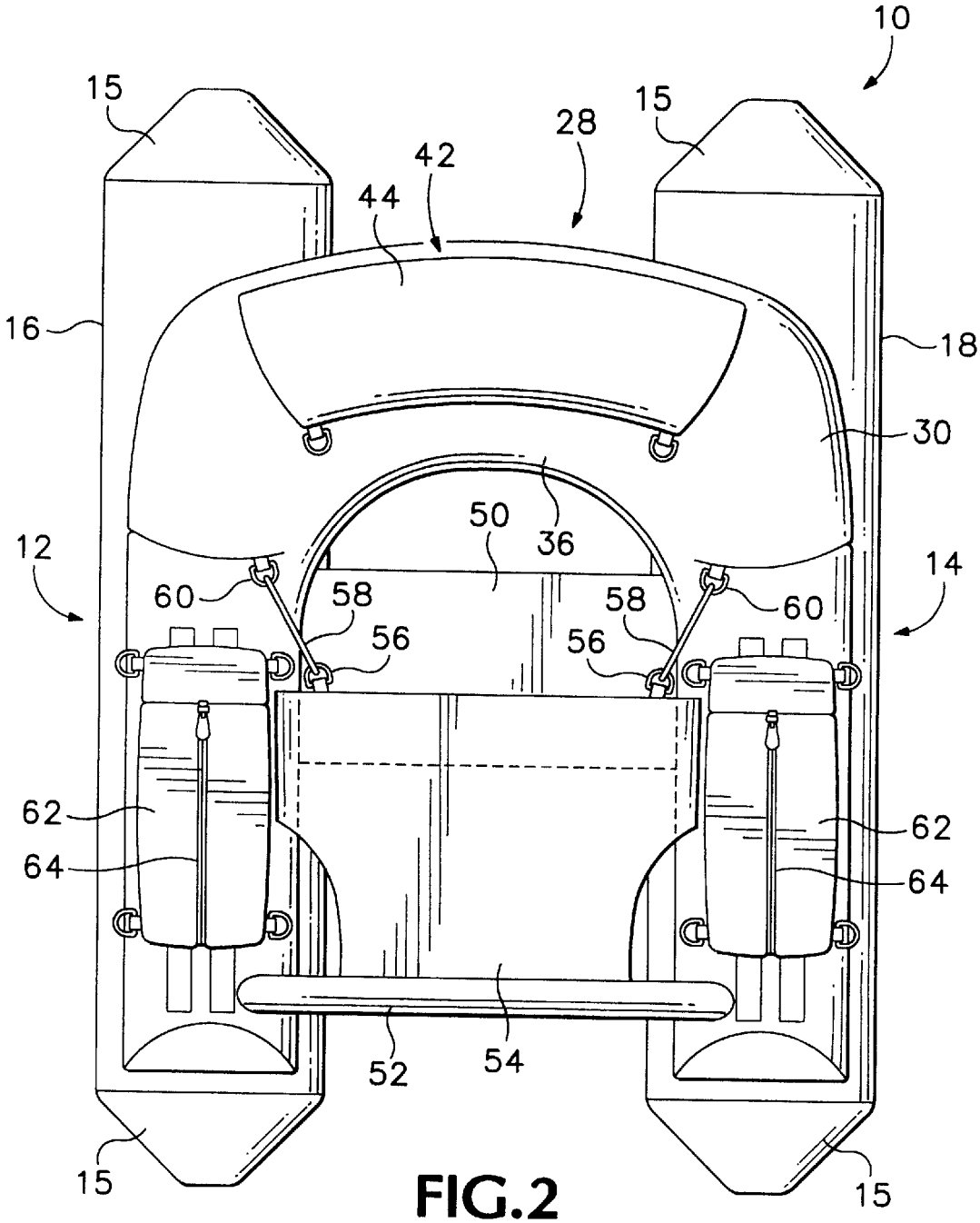
FIG. 2 is a plan view of the float tube of FIG. 1.
Figure 3:
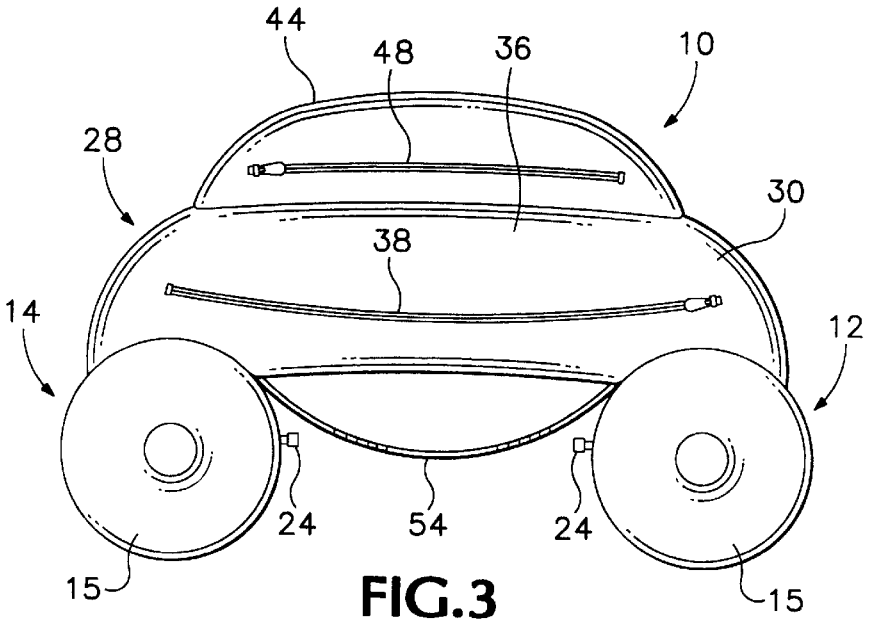
FIG. 3 is a rear elevation view of the float tube.
Figure 4:
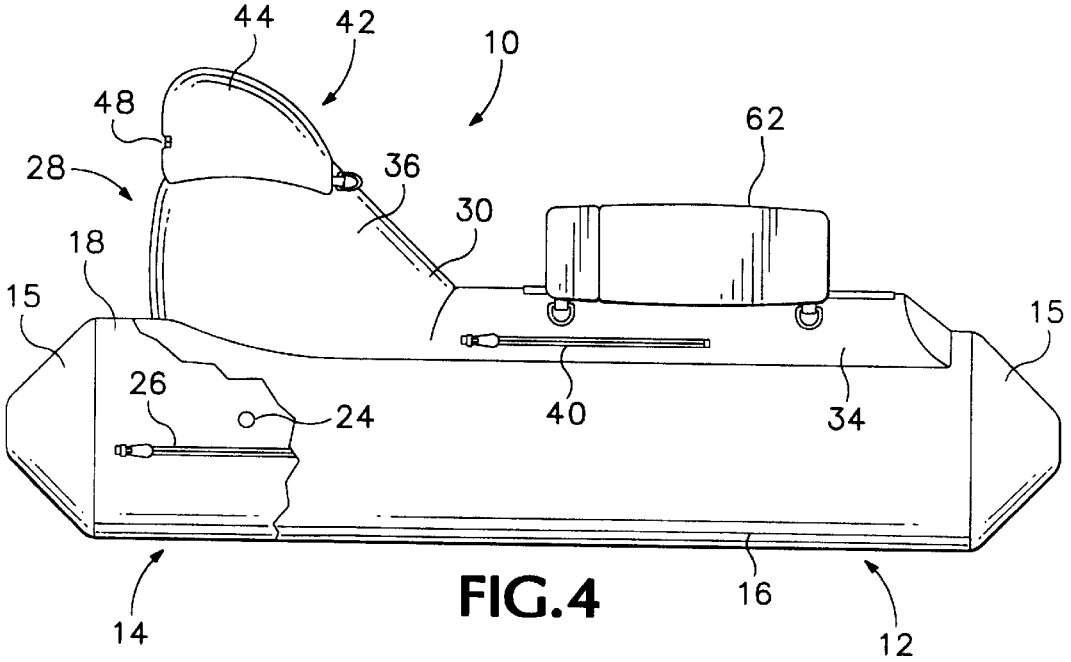
FIG. 4 is a side elevation view, partially broken away to show hidden detail.

Referring now to the drawings, a float tube comprises first and second elongate cylindrical pontoons 12 and 14. The pontoons are oriented parallel to one another with a separation of approximately 20 inches between them. In a preferred embodiment, the pontoons are approximately 5 feet long and 1 foot in diameter. The front and rear-ends 15 of the pontoons are conical.

The pontoons comprise first and second pontoon covers 16 and 18 which contain inflatable first and second pontoon bladders 20 and 22. The pontoon covers are made from a tough, puncture resistant material such as 400 diener nylon packcloth. The bladders are made from a flexible material such as vinyl. Openings in the pontoon covers allow the valve stems 24 of the bladders to protrude from the pontoons. Openings 26 (not shown) run along the inner edge of each pontoon cover to allow insertion of the pontoon bladders into the covers. The openings are closable by means such as zippers 26 when the bladders are installed.

Mounted on top of the pontoons 12 and 14 is a generally U-shaped support 28. The support 28 holds the pontoons 12, 14 parallel with one another with the proper separation between them. The support comprises a support cover 30 which contains a support bladder 32. The support cover and bladder preferably are made from the same material as the pontoon covers and bladders, but may be a contrasting color. The support cover 30 has a pair of parallel, spaced-apart arms 34 and a back support member 36. The arms are crescent shaped in cross-section, and one arm is attached to the top of each pontoon cover by sewing. The arms 34 overlay a substantial portion of the length of the pontoons. The arms 34 overlay a substantial portion of the length of the pontoons. The arms 34 are interconnected by the back support member 36, which is considerably higher than the arms.

An opening (not shown) is located at the rear of the back support portion of the cover 30 to allow the support bladder 32 to be inserted into it. The opening is closeable with a zipper 38. In addition, smaller openings (not shown) are located in each arm 34 to allow the support bladder to be pulled to the front of the arms. These openings are also closeable with zippers 40. The support bladder has a valve stem (not shown) which projects out of the support cover to allow the support bladder to be inflated.

Located on top of the support 28, is a headrest 42. The headrest comprises a headrest cover 44 and a headrest bladder 46. The headrest cover is sewn onto the support cover. An opening (not shown) in the back of the headrest cover allows the headrest bladder to be inserted into the cover. This opening is closeable with a zipper 48. The headrest bladder has a valve stem (not shown) which projects out of the headrest cover to allow the headrest to be inflated. The headrest cover and bladder preferably are made out of the same material as the other covers and bladders.

Extending between the pontoons, in front of the back support 36, is a flexible seat 50. Preferably, the seat is attached to the pontoon covers at the same point that the arms 34 are attached, and it is made from the same material as the covers. The seat is positioned so that someone sitting on it can comfortably lean back against the back support.

Located near the front of the pontoons is a rigid separation element 52, which extends between the arms 34 to keep the front of the pontoon separated by the desired distance. The front side of a fabric shelf 54 wraps around the separation element and extends over the user's lap when sitting on the seat 50. The back of the separation element has straps 56 at each side with hooks 58 that releasably connect to D rings 60 which are attached to the arms 34. This allows the shelf to be moved out of the user's way when entering or leaving the float tube. There also are D rings 62 located at various places around the float tube for attaching items to it.

In the embodiment illustrated, pouches 62 are mounted on top of each leg 34. The pouches are made from the same material as the covers and are sewn onto the support cover. The pouches have zippered opens 64 which allow items to be securely stowed inside them.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An inflatable float tube comprising:

(a) Separate first and second elongate, cylindrical pontoon covers, having front ends and rear ends;

(b) First and second inflatable bladders configured to fit within said first and second pontoon covers, respectively;

(c) A generally U-shaped support cover having spaced apart arms and a back support member which interconnects said arms;

(d) A generally U-shaped support bladder configured to fit within said U-shaped support cover;

(e) Wherein one arm of said U-shaped support cover is attached to each of said first and second pontoon covers;

(f) Wherein said back support member is located proximate the rear ends of said first and second pontoon covers;

(g) A seat which extends between said first and second pontoon covers forwardly of said back support member; and a rigid separation element which extends between said pontoons proximate their front ends.

2. An inflatable float tube comprising:

(a) separate first and second elongate, cylindrical pontoon covers, having front ends and rear ends;

(b) first and second inflatable bladders configured to fit within said first and second pontoon covers, respectively;

(c) a generally U-shaped support cover having spaced-apart ends and a back support member which interconnects said ends;

(d) a generally U-shaped support bladder configured to fit within said U-shaped support cover;

(e) wherein one end of said U-shaped support cover is attached to each of said first and second pontoon covers;

(f) wherein said back support member is located proximate the rear ends of said first and second pontoon covers;

(g) a seat which extends between said first and second pontoon covers forwardly of said back support member; and (h) a rigid separate element which extends between said pontoons proximate their front ends.

* * * * *